US010837451B2

(12) United States Patent
Yakubova et al.

(10) Patent No.: US 10,837,451 B2
(45) Date of Patent: Nov. 17, 2020

(54) INFLATOR

(71) Applicant: TTI (MACAO COMMERCIAL OFFSHORE) LIMITED, Macau (MO)

(72) Inventors: Svetlana Yakubova, Greer, SC (US); Jesse J. Jerabek, Easley, SC (US); Ryan Altenburger, Greenville, SC (US)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 229 days.

(21) Appl. No.: 15/861,743

(22) Filed: Jan. 4, 2018

(65) Prior Publication Data

US 2018/0187687 A1 Jul. 5, 2018

Related U.S. Application Data

(60) Provisional application No. 62/442,265, filed on Jan. 4, 2017.

(51) Int. Cl.

| | |
|---|---|
| ***F04D 25/08*** | (2006.01) |
| ***F04D 25/06*** | (2006.01) |
| ***F04D 13/06*** | (2006.01) |
| ***A47C 27/08*** | (2006.01) |
| ***F04D 17/16*** | (2006.01) |

(52) U.S. Cl.

CPC ..... *F04D 25/084* (2013.01); *A47C 27/082* (2013.01); *F04D 13/068* (2013.01); *F04D 17/16* (2013.01); *F04D 25/0673* (2013.01); *F04D 25/08* (2013.01)

(58) Field of Classification Search

CPC .... F04D 13/068; F04D 25/0673; F04D 25/08; F04D 25/084; A47C 27/082; A47J 37/0752; A45D 20/10

See application file for complete search history.

(56) References Cited

U.S. PATENT DOCUMENTS

| | | | | |
|---|---|---|---|---|
| 3,647,323 A * | 3/1972 | Thomas | F04D 25/084 | 417/234 |
| 4,033,511 A * | 7/1977 | Chamberlin | B05B 7/2416 | 239/346 |
| 4,222,525 A * | 9/1980 | Hildebrandt | B05B 7/2416 | 222/401 |

(Continued)

FOREIGN PATENT DOCUMENTS

| | | |
|---|---|---|
| DE | 20100015 U1 | 8/2001 |
| DE | 202012100512 U1 | 3/2012 |

OTHER PUBLICATIONS

Australian Patent Office Examination Report for Application No. 2018200068 dated Oct. 25, 2018, 3 pages.

*Primary Examiner* — Peter J Bertheaud

(74) *Attorney, Agent, or Firm* — Michael Best & Friedrich LLP

(57) ABSTRACT

An inflator tool includes a handle portion extending between a battery receiving portion and a tool head portion. The handle portion defines a longitudinal axis. The tool head portion includes an air inlet, a compression chamber, and an air outlet. A motor is at least partially supported within the handle portion and includes an output shaft. The air inlet defines an inlet axis, and the air outlet defines an outlet axis. The longitudinal axis is disposed at an oblique angle relative to each of the inlet axis and the outlet axis.

13 Claims, 9 Drawing Sheets

(56) References Cited

U.S. PATENT DOCUMENTS

| | | | | | |
|---|---|---|---|---|---|
| 4,516,561 | A * | 5/1985 | Stawski | A47J 37/0754 | 126/25 B |
| 5,613,890 | A * | 3/1997 | DeMars | A63H 33/28 | 446/15 |
| 5,938,410 | A * | 8/1999 | Lee | A47L 5/14 | 15/330 |
| 6,045,341 | A * | 4/2000 | Mak | A63H 27/14 | 417/411 |
| 6,155,781 | A * | 12/2000 | Tsai | F04D 25/084 | 415/182.1 |
| 6,468,047 | B1 | 10/2002 | Huang et al. | | |
| 9,707,580 | B1 * | 7/2017 | Mancl | B05B 7/2491 | |
| 2005/0042051 | A1 | 2/2005 | Obermeier et al. | | |

* cited by examiner

INFLATOR

CROSS-REFERENCE TO RELATED APPLICATIONS

This application claims priority to pending U.S. Provisional Patent Application No. 62/442,265, filed on Jan. 4, 2017, the entire contents of which are incorporated herein by reference.

FIELD OF THE INVENTION

The present invention relates to an inflator, and more particularly to a handheld inflator tool.

BACKGROUND OF THE INVENTION

Inflators are used to drive air into an inflatable device. Inflators generally include a fan or rotor to drive pressurized airflow from an inlet of the tool into the inflatable device.

SUMMARY OF THE INVENTION

The invention provides, in one aspect, an inflator tool including a handle portion extending between a battery receiving portion and a tool head portion. The handle portion defines a longitudinal axis. The tool head portion includes an air inlet, a compression chamber, and an air outlet. A motor is at least partially supported within the handle portion and includes an output shaft. The air inlet defines an inlet axis, and the air outlet defines an outlet axis. The longitudinal axis is disposed at an oblique angle relative to each of the inlet axis and the outlet axis.

The invention provides, in another aspect, a combination inflator and deflator tool including a handle portion extending between a battery receiving portion and a tool head portion. The tool head portion includes an air inlet, a compression chamber, and an air outlet. The air inlet is disposed along a first axis, and the air outlet is disposed along a second axis that is substantially orthogonal to the first axis.

The invention provides, in yet another aspect, an inflator and deflator tool including a handle portion extending between a battery receiving portion and a tool head portion. A motor is at least partially supported within the handle portion, and includes an output shaft defining a motor axis. An air driving assembly is supported within a compression chamber of the tool head portion. The air driving assembly is configured to drive air from an air inlet, disposed on a top surface of the tool, into the compression chamber and out of an air outlet formed on the tool head portion. The air inlet extends along a first direction that is collinear with the motor axis, and the air outlet extends along a second direction substantially orthogonal to the first direction.

Other features and aspects of the invention will become apparent by consideration of the following detailed description and accompanying drawings.

Before any embodiments of the invention are explained in detail, it is to be understood that the invention is not limited in its application to the details of embodiment and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 7:
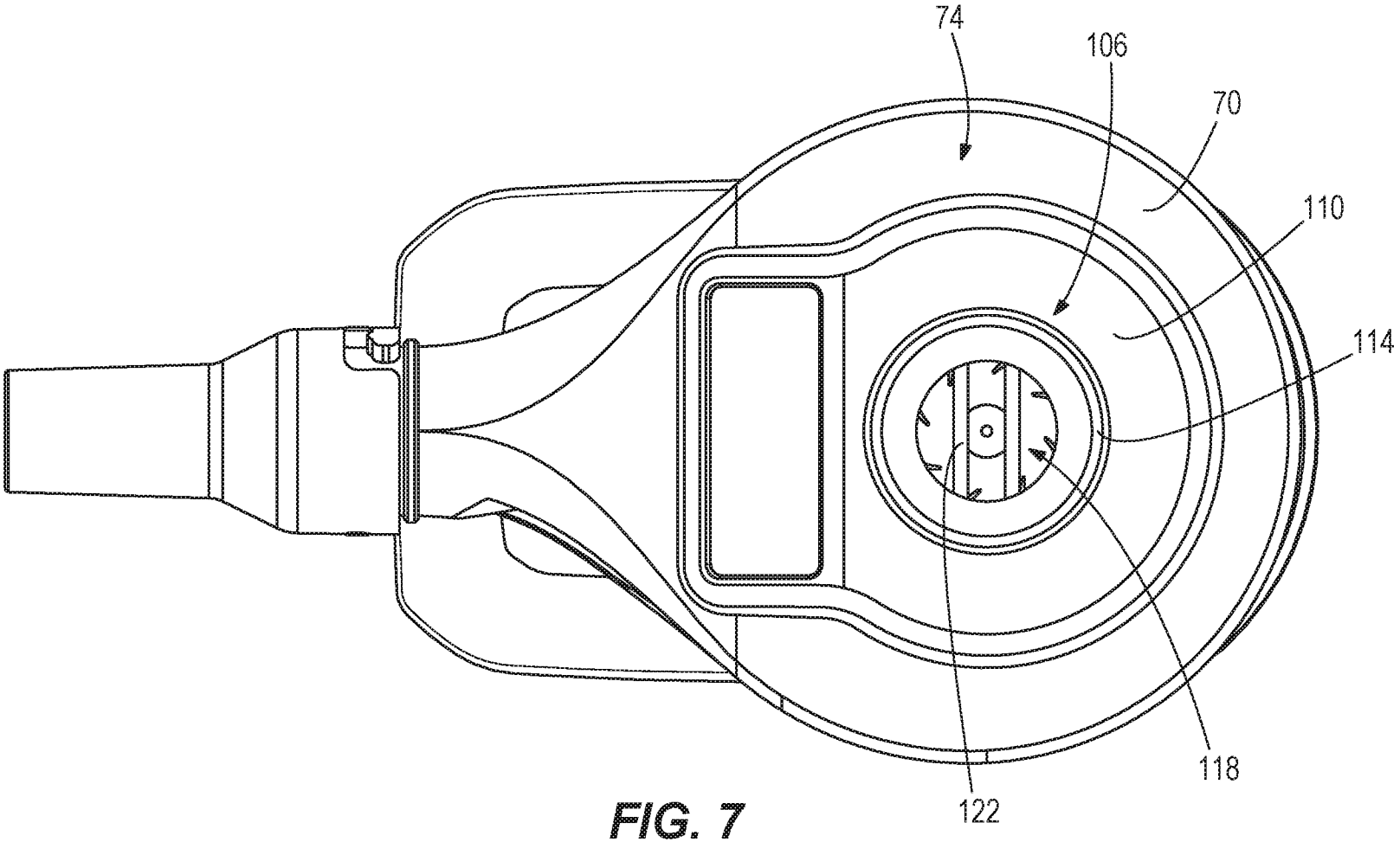
FIG. 7 is a top view of the inflator tool.
Figure 8:
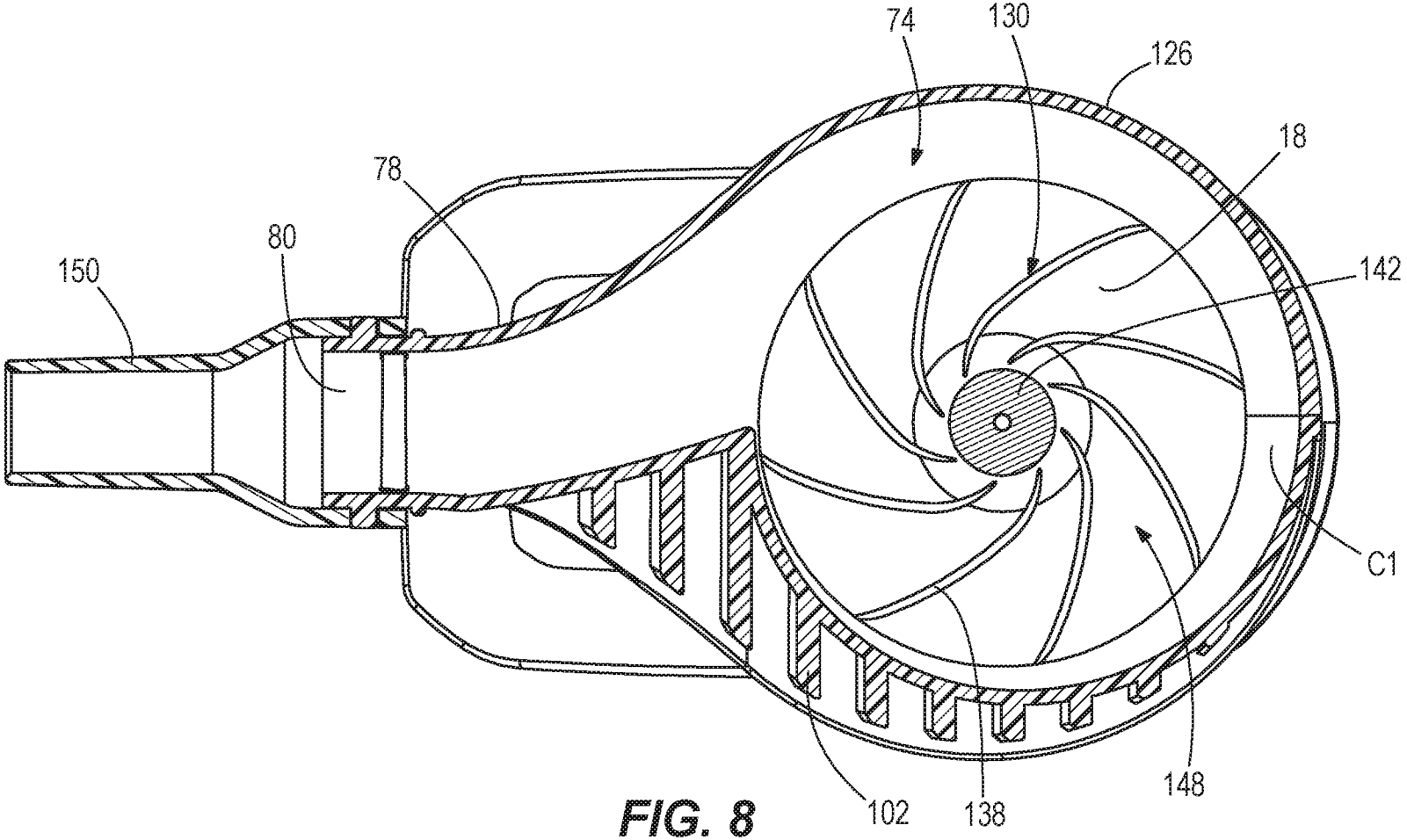
FIG. 8 is a top view of a cross section taken along line 8-8 of the inflator tool in FIG. 3.
Figure 9:
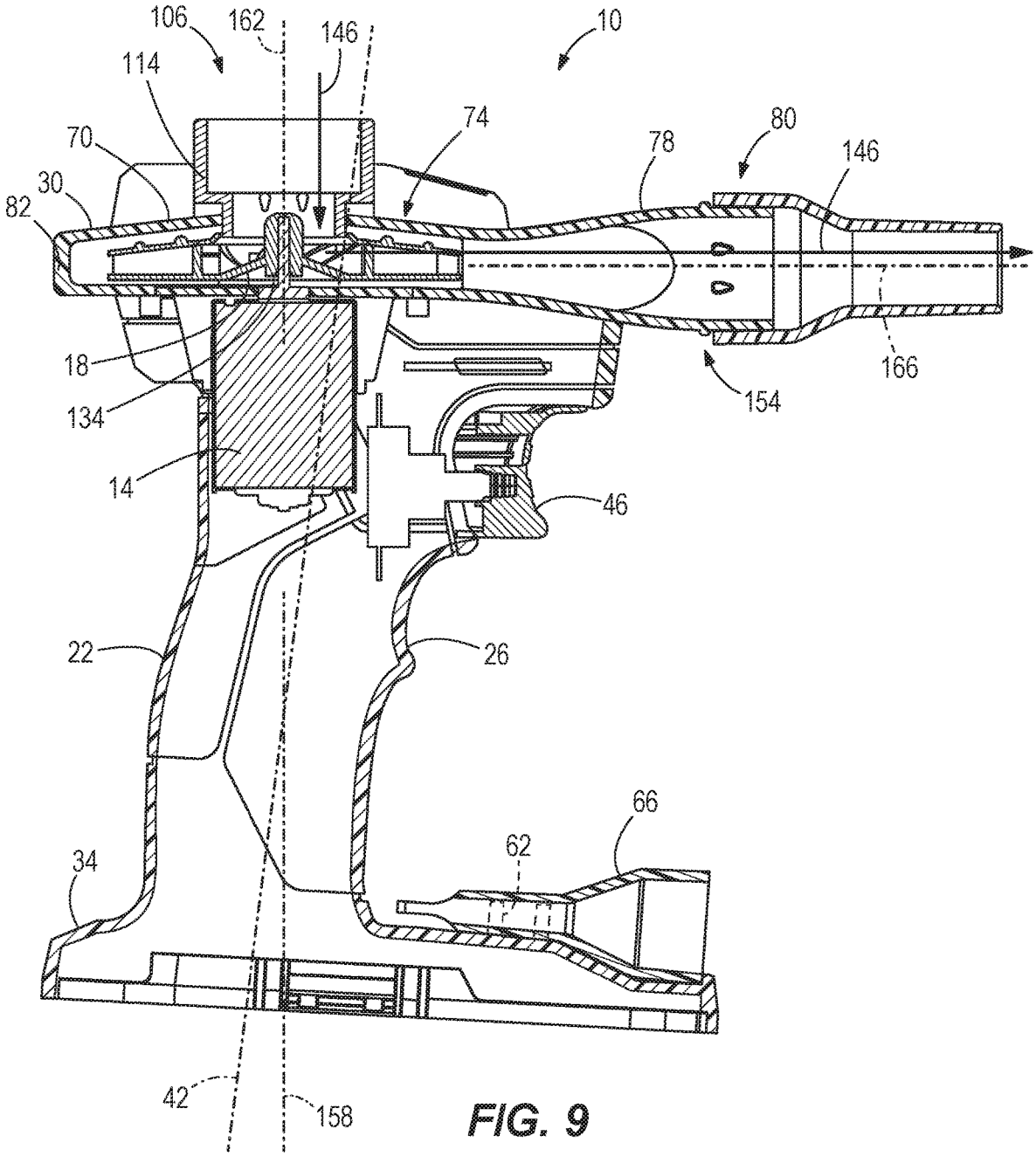
FIG. 9 is a side view of a cross section taken along line 9-9 of the inflator tool in FIG. 5.

FIGS. 1-9 illustrate an inflator tool 10 that is used to inflate or deflate inflatable devices (e.g., an air mattress, a tire, etc.). The inflator tool 10 is a handheld, battery operated power tool having a motor 14 (e.g., a brushed or brushless AC or DC motor 14) operatively coupled to a rotor or fan 18 that drives pressurized airflow (FIG. 9). As will be described in greater detail below, the spatial configuration of the components of the inflator tool 10 allow for a compact inflator.

The inflator tool 10 includes a housing 22 having a handle portion 26 extending between a tool head portion 30 and a battery receiving portion 34. The handle portion 26 includes a generally cylindrical grip 38 defining a longitudinal axis 42 of the handle portion 26. The handle portion 26 further includes an actuator 46 (e.g., a trigger) movable relative to the handle portion 26 that is configured to control operation of the inflator tool 10 (e.g., activate the motor 14). At least a portion of the motor 14 is supported within the handle portion 26 (FIG. 9).

Figure 1:
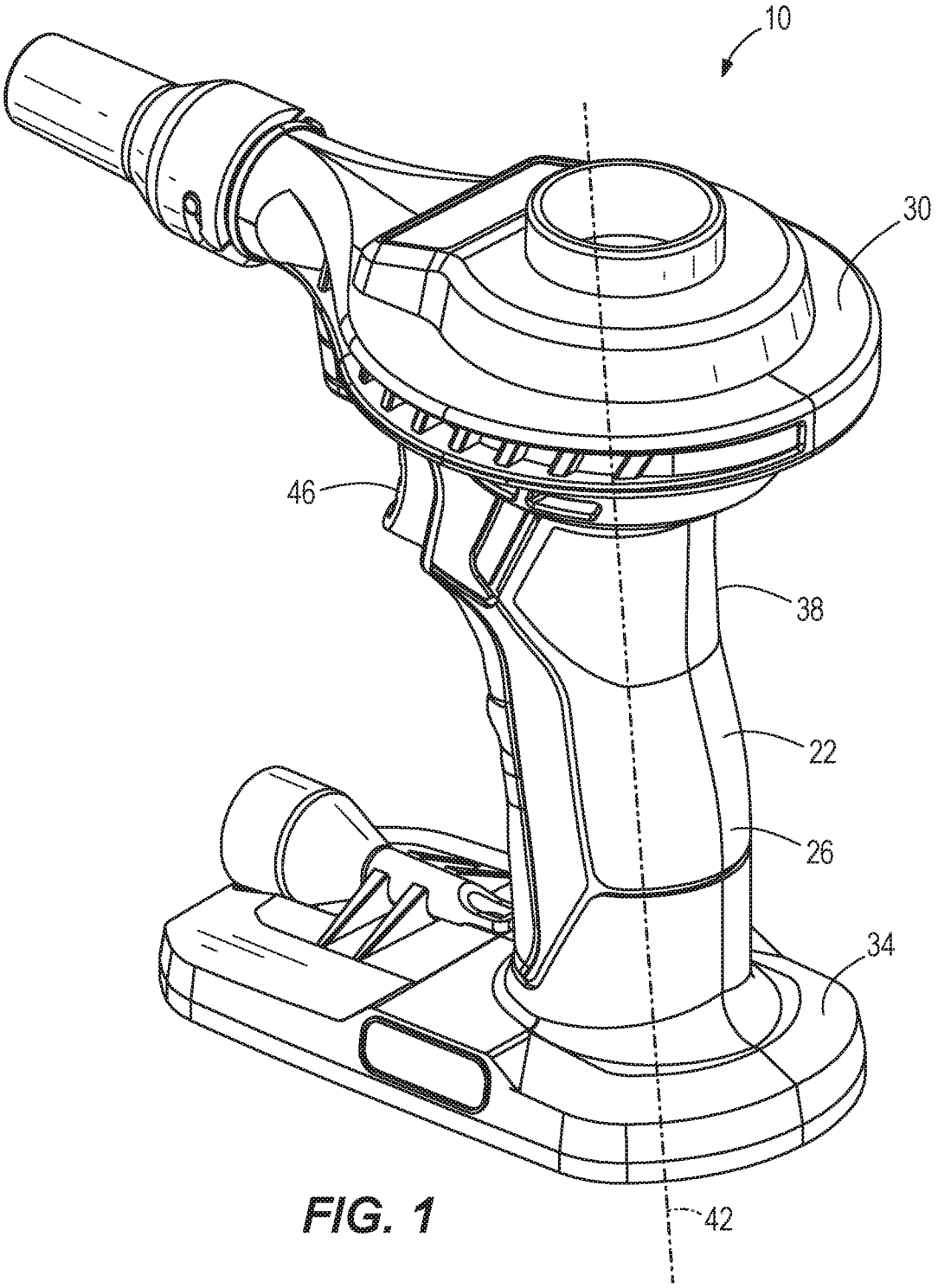
FIG. 1 is a perspective view of an inflator tool.
Figure 2:
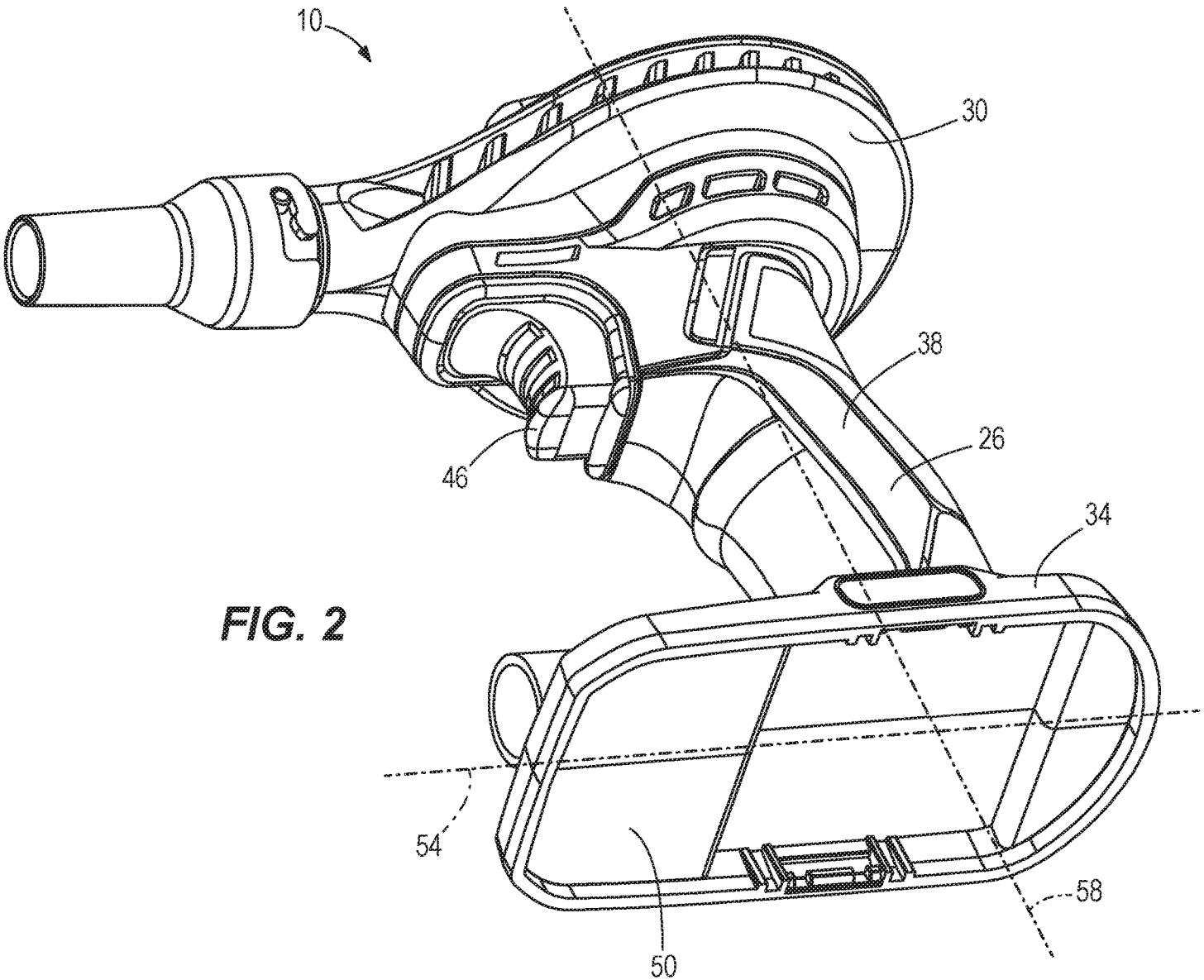
FIG. 2 is a second perspective view of the inflator tool.

With reference to FIG. 2, the battery receiving portion 34 is disposed at a first end of the handle portion 26 and is configured to detachably receive a rechargeable power tool battery pack (e.g., a lithium-ion battery pack; not shown) within a battery cavity 50. The battery cavity 50 is disposed on a lower surface of the tool 10 and includes engagement features to electrically and mechanically couple the battery pack such that the battery pack can provide power to the inflator tool 10. The engagement features include, for example, electrical contacts to facilitate electrical communication, alignment members guiding attachment of the battery pack, and a latch mechanism to maintain engagement of the battery pack to the tool.

In one embodiment, the battery pack is a 'slide on' battery pack that is attached to the inflator tool 10 along a first battery insertion axis 54 that extends in a direction that is generally orthogonal to the longitudinal axis 42 of the handle portion 26 (FIG. 2). In another embodiment, the battery pack is an axially insertable battery pack that is attached to the inflator tool 10 along a second battery insertion axis 58 that is generally parallel to or collinear with the longitudinal axis 42 of the handle portion 26 (FIG. 2). In yet another embodiment, the inflator tool 10 is configured to be coupled to an external power source via a cord (i.e., the inflator tool 10 is a corded power tool).

Figure 3:
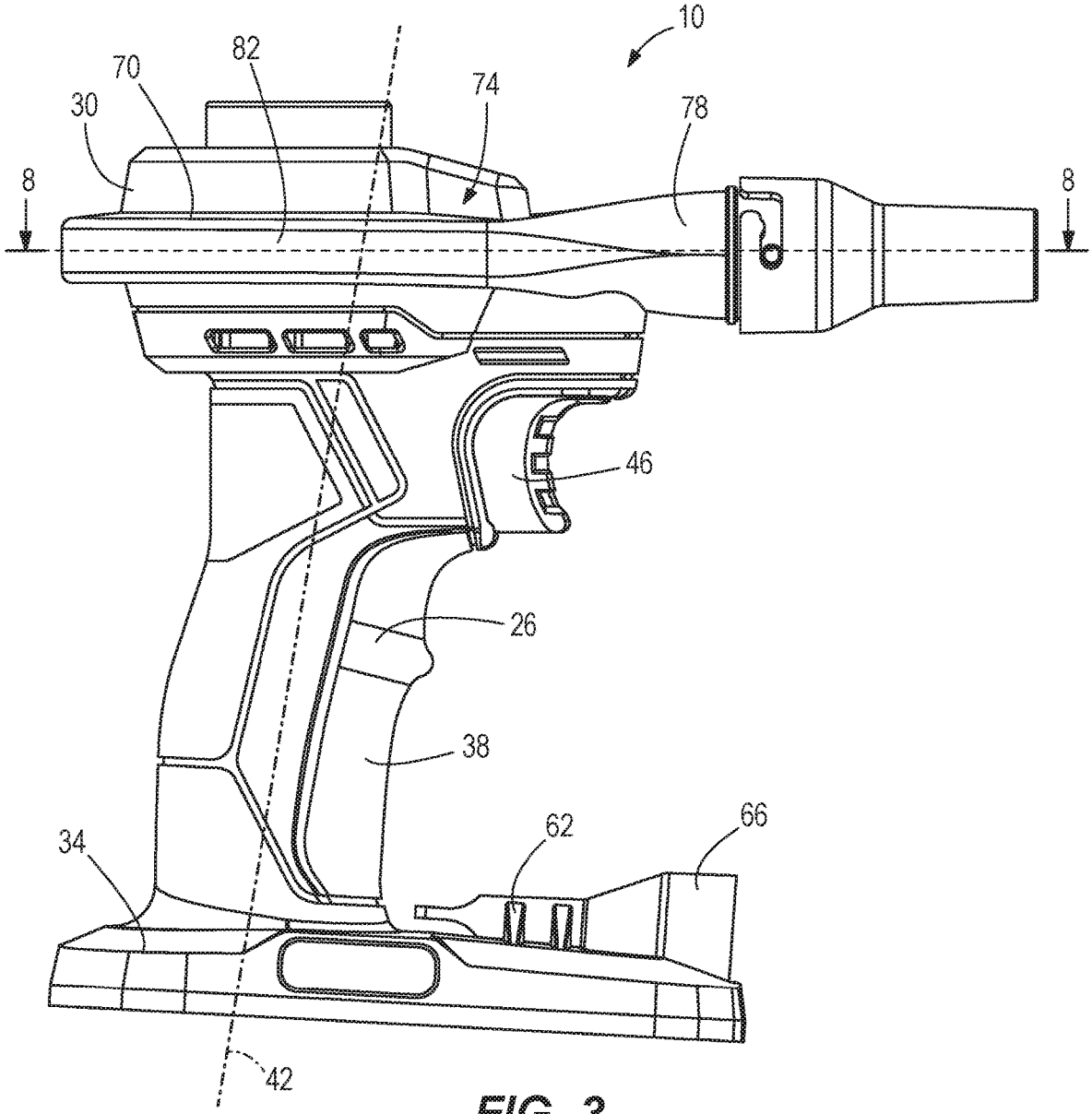
FIG. 3 is a first side view of the inflator tool.
Figure 4:
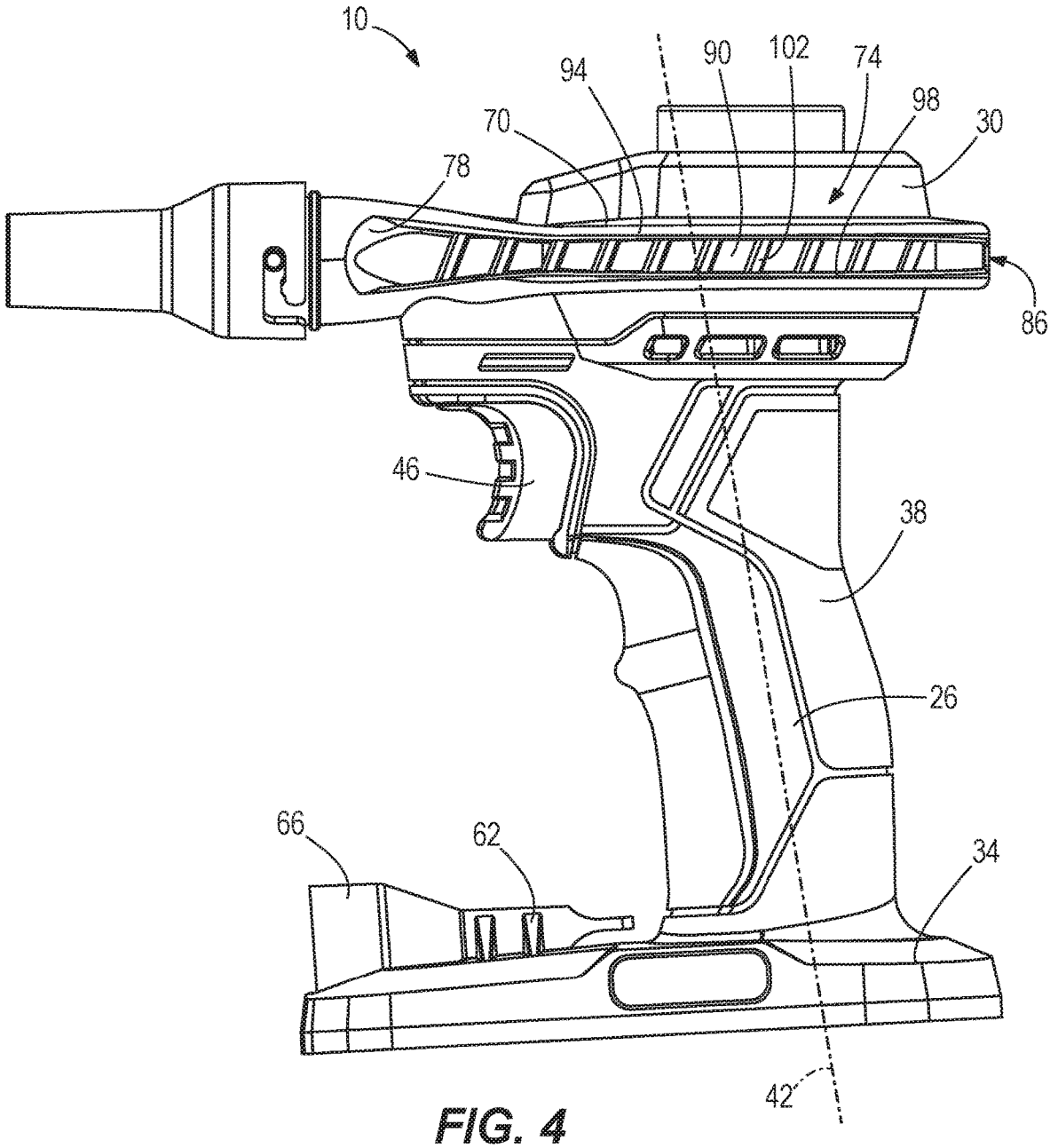
FIG. 4 is a second side view of the inflator tool.
Figure 5:
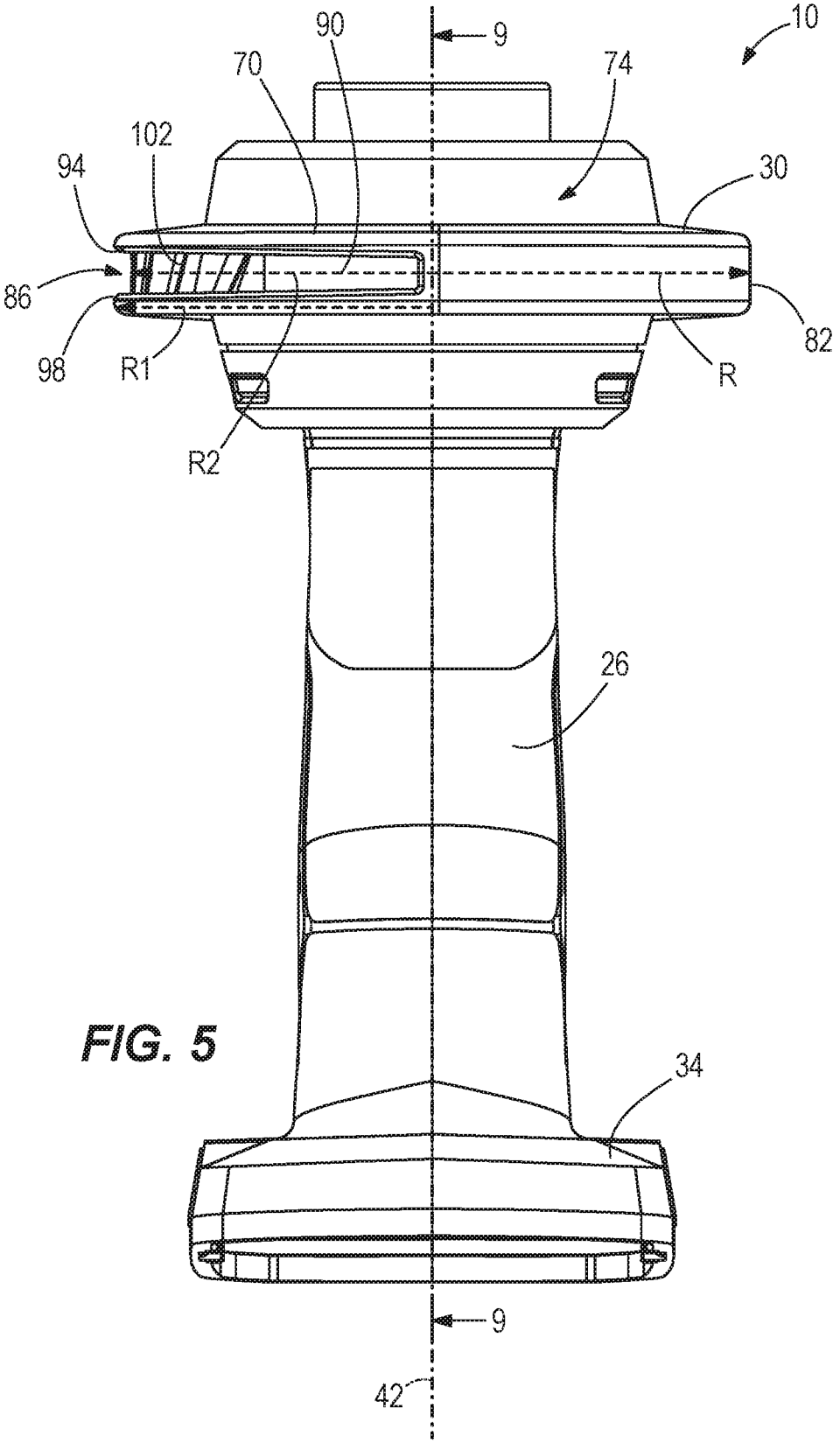
FIG. 5 is a rear view of the inflator tool.
Figure 6:
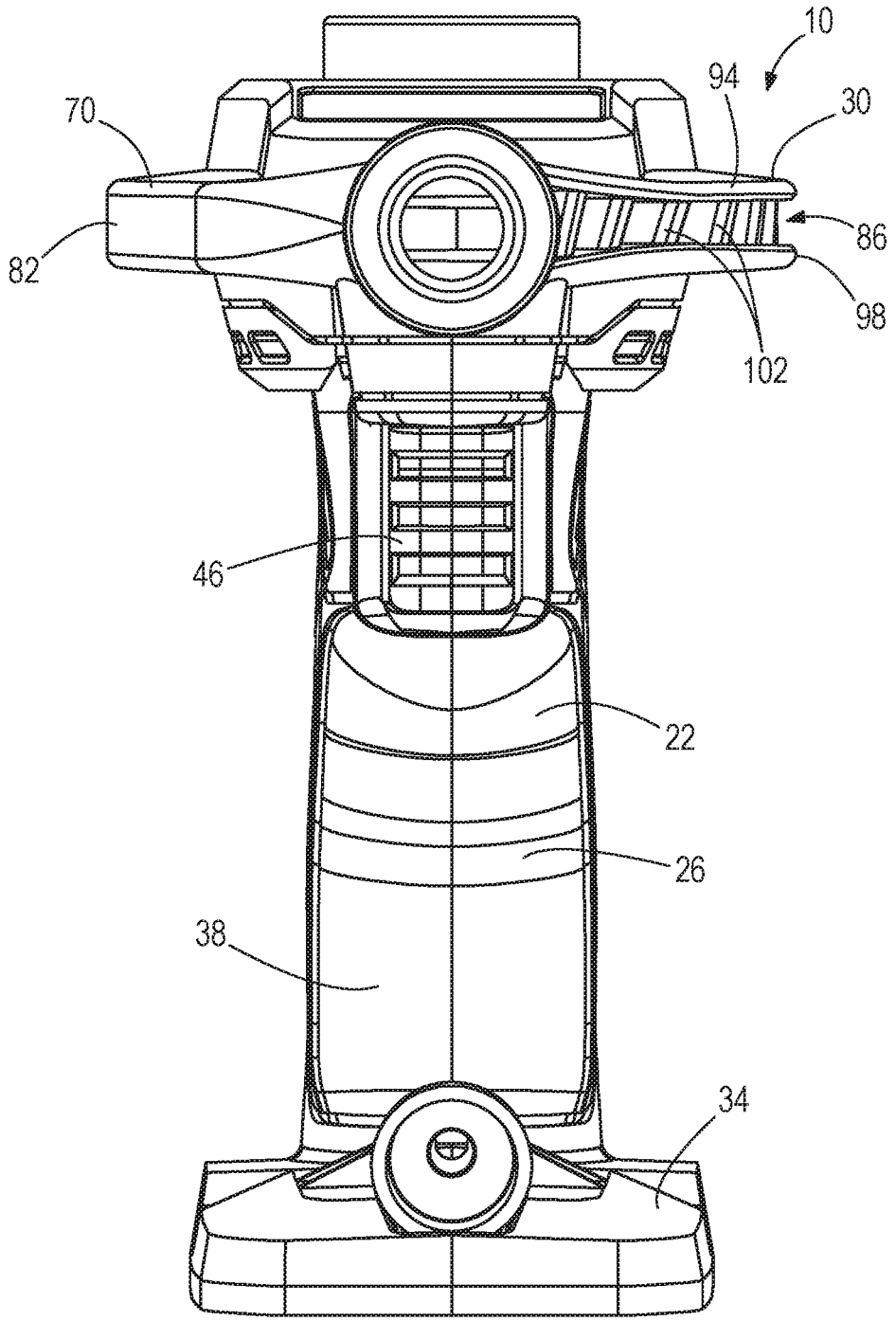
FIG. 6 is a front view of the inflator tool.

With reference to FIGS. 3 and 4, the battery receiving portion 34 also includes a retention member 62 disposed on a surface of the battery receiving portion 34 that is opposite the battery cavity 50. The retention member 62 releasably retains at least one inflator tool accessory 66, such as an inflation adapter or a deflation adapter. The retention member 62 may engage the inflator tool 10 accessories by any known mechanism (e.g., interference fit, snap fit, threaded engagement, sliding engagement, etc.).

With continued reference to FIGS. 3 and 4, the tool head portion 30 is disposed on a second end of the handle portion 26 and is defined by a substantially arcuate body 70 and an outlet body 78 extending radially away from the arcuate body 70. The body 70 delimits an air driving chamber or compression chamber 74 extending concentrically about the rotor 18 (FIGS. 8-9). One lateral side of the body 70 includes a planar outer surface 82 (FIG. 3). An opposite side of the body 70 includes a channel 86 defined by an inner wall 90 facing laterally outward, an upper surface 94, a lower surface 98 and ribs 102 extending between the upper surface 94 and the lower surface 98 (FIG. 4). As seen in FIGS. 4-7, an outer periphery of the upper and lower surfaces 94, 98 defines a first radius R1 of the body 70 that is substantially equivalent to a radius R defined by the planar outer surface 82. However, the inner wall 90 defines a second radius R2 that is less than the first radius R1. As will be described in greater detail below, this results in the compression chamber 74 having a spirally shaped delimiting interior wall 126 (FIG. 8).

With reference to FIG. 7, an air inlet 106 is formed on a top surface 110 of the arcuate body 70 to fluidly communicate the air compression chamber 74 with the surrounding environment. The air inlet 106 includes a cylindrical inlet member 114 having a bore 118 extending therethrough. In the illustrated embodiment, the bore 118 includes one or more ribs or vanes 122 extending across the bore 118 that may, for example, prevent foreign objects from entering the compression chamber 74. As seen in FIG. 7, the illustrated inlet member 114 is disposed in a central location on the top surface 110 of the arcuate body 70.

With reference to FIG. 8, the compression chamber 74 is delimited by the interior wall 126 extending around an air driving assembly 130 that is a centrifugal fan or pump including the rotor 18 in the illustrated embodiment. The rotor 18 is operatively coupled to an output shaft 134 of the motor 14 (FIG. 9) and includes curved blades 138 extending from a hub 142 toward the interior wall 126. The interior wall 126 is a curved wall having a center defined by the center of the rotor 18. A radius defined by the wall 126 increases along a circumferential direction of the wall 126 (e.g., along a counter-clockwise direction with respect to FIG. 8). Accordingly, a circumferential clearance C1 is defined between an outer periphery of the rotor 18 and the interior wall 126. The circumferential clearance C1 is in fluid communication with the outlet body 78.

With continued reference to FIG. 8, channels 148 in the rotor 18 are defined between adjacent blades 138, such that the channels 148 extend from the hub 142 to the outer periphery of the rotor 18. The channels 148 fluidly communicate the air inlet 106 with the circumferential clearance C1.

The outlet body 78 extends away from the arcuate body 70 and defines an air outlet 80 (FIG. 8). The air outlet 80 includes at least one retention member for engaging an inflation adapter 150. In the illustrated embodiment, the retention member is a bayonet style retention mechanism including a protrusion on the tool that is received and retained within a slot of the adapter 150. However, other retention mechanisms (e.g., interference fit, threaded engagement, etc.) may be used in place of the bayonet style retention mechanism.

With reference to FIGS. 8 and 9, the outlet body 78 expands in the radial direction moving towards the air outlet 80 to define a diffusion portion 154. At the air outlet 80, the inflation adapter 150 may be attached. In the illustrated example, the inflation adapter 150 includes a body that narrows radially inwardly to define a nozzle portion. However, in other embodiments, the outlet body 78, the inflation adapter 150 or both the outlet body 78 and the inflation adapter 150 may extend linearly (i.e., a diffusion portion or a nozzle portion are not defined).

Collectively, the air inlet 106, the compression chamber 74, and the air outlet 80 define an airflow path 146 extending through the inflator tool 10 (FIG. 9). Air is drawn in through the air inlet 106 to the compression chamber 74, where the air is pressurized/accelerated and driven through the outlet body 78 toward the air outlet 80. More specifically, air drawn through the air inlet 106 enters the compression chamber 74 at the hub 142 of the rotor 18 and is directed to flow radially outwardly along the channels 148 of the rotor 18. After exiting the rotor 18, the air enters into the circumferential clearance C1 and is directed to flow to the outlet body 78 (e.g., in a counter-clockwise direction in FIG. 8). From the outlet body 78, the air is directed out of the air outlet 80.

FIG. 9 illustrates the spatial relationships and orientations of the components of the inflator tool 10. The motor 14 includes the output shaft 134 operatively coupled to the rotor 18. The output shaft 134 defines a motor axis or rotor rotation axis 158. The inlet member 114 and the air inlet 106 define an air inlet axis 162 that is generally coaxial with the motor axis 158. However, in other embodiments, the inlet member 114 may be disposed on the housing 22 at different location such that the air inlet axis 162 is spaced from the motor axis 158. In such an embodiment, the air inlet axis 162 may be parallel to the motor axis 158, or alternatively may be disposed at an oblique angle relative to the motor axis 158.

With continued reference to FIG. 9, the motor axis 158 is disposed an oblique angle relative to the longitudinal axis 42 of the handle portion 26 (e.g., an angle that is less than approximately 30 degrees). However, in other embodiments, the motor axis 158 and the axis 42 of the handle may be parallel or collinear.

With continued reference to FIG. 9, the outlet body 78 extends along an outlet axis 166 that is substantially orthogonal to the motor axis 158 and the air inlet axis 162. In addition, the outlet axis 166 is angled relative to the longitudinal axis 42 of the handle portion (e.g., an angle of approximately 60-120 degrees). This orientation results in the airflow path 146 entering along a first axis and exiting along a second axis. However, in other embodiments, the outlet axis 166 may be disposed at an oblique angle to the air inlet axis 162 and/or the motor axis 158.

In operation, a user couples the inflator tool 10 to an inflatable device (e.g., via engagement between the inflation adapter 150 and a port on the inflatable device) and operates the actuator 46 to drive the motor 14 and, in turn, the rotor 18. Rotation of the rotor 18 draws air into the compression chamber 74 via the air inlet 106 towards the hub 142, where the air is directed into the channels 148 between the blades 138. The air in the channels 148 is driven in a radial and circumferential direction to drive airflow into the circumferential clearance C1 and along the interior wall 126 toward the outlet body 78. When the air reaches the diffusion portion of the outlet body 78, the air is decelerated and the pressure is increased as it continues toward the air outlet 80. At the air outlet 80, when the inflation adapter 150 is attached, the nozzle portion accelerates the air and the pressure is decreased as it exits the air outlet 80 and enters the inflatable device.

When the inflator tool 10 is desired for use as a deflator tool, a user may couple the inlet member 114 to the port of an inflatable device either directly or via an adapter. As described above, the user will then operate the inflator tool 10 to drive airflow through the air inlet 106 and out of the air outlet 80, thereby driving air out of the inflatable device.

The inflator tool 10 described above advantageously provides a compact tool for driving airflow based on the spatial configuration and components of the tool described above. In addition, the tool provides a handheld, 'pistol grip' style powered tool for inflating and deflating inflatable devices.

Although the invention has been described in detail with reference to certain preferred embodiments, variations and modifications exist within the scope and spirit of one or more independent aspects of the invention as described. Various features of the invention are set forth in the following claims.

What is claimed is:

1. An inflator tool comprising:

a handle portion extending between a battery receiving portion and a tool head portion, the handle portion defining a longitudinal axis, and the tool head portion including an air inlet, a compression chamber, and an air outlet; and a motor at least partially supported within the handle portion and including an output shaft, wherein the air inlet defines an inlet axis, and the air outlet defines an outlet axis, wherein the longitudinal axis is disposed at an oblique angle relative to each of the inlet axis and the outlet axis, wherein the tool includes an outer housing forming at least the tool head portion, wherein the air inlet is formed on a surface of the outer housing, and wherein the air inlet is configured to receive air from a surrounding environment, and all of the air received through the air inlet is configured to directly enter the compression chamber.

2. The inflator tool of claim 1, wherein the output shaft defines a motor axis, the motor axis parallel with the inlet axis, and wherein the motor axis is substantially orthogonal to the outlet axis.

3. The inflator tool of claim 1, wherein the inlet axis is substantially orthogonal to the outlet axis.

4. The inflator tool of claim 1, further comprising an air driving assembly including a rotor supported within the tool head portion, the motor operatively coupled to the rotor for driving pressurized airflow from the air inlet to the air outlet, wherein the compression chamber extends around the air driving assembly.

5. The inflator tool of claim 4, wherein the tool head portion includes an arcuate body and an outlet body extending radially away from the arcuate body, the arcuate body delimiting the compression chamber extending concentrically about the rotor.

6. The inflator tool of claim 1, wherein the compression chamber includes a spirally shaped delimiting wall extending around the compression chamber, the wall having a center defined by a center of a rotor positioned within the compression chamber.

7. The inflator tool of claim 6, further comprising a circumferential clearance defined between an outer periphery of the rotor and the wall, the circumferential clearance in fluid communication with the air outlet.

8. The inflator tool of claim 6, further comprising a radius defined by the wall, the radius increasing along a circumferential direction of the wall to form a circumferential clearance.

9. The inflator tool of claim 8, wherein the rotor includes channels defined between adjacent blades of the rotor, the channels extending from the center towards an outer periphery of the rotor, the channels fluidly communicating the air inlet with the circumferential clearance.

10. An inflator and deflator tool comprising:

a handle portion extending between a battery receiving portion and a tool head portion, the battery receiving portion positioned at an end of the handle portion;

a motor at least partially supported within the handle portion and including an output shaft defining a motor axis; and an air driving assembly supported within a compression chamber of the tool head portion, the air driving assembly configured to drive air from an air inlet, disposed on a top surface of the tool, into the compression chamber and out of an air outlet formed on the tool head portion, wherein the air inlet extends along a first direction that is collinear with the motor axis, and the air outlet extends along a second direction substantially orthogonal to the first direction, wherein the tool includes an outer housing forming at least the tool head portion, the outer housing having the top surface, and wherein the handle portion defines a longitudinal axis, the longitudinal axis disposed at an oblique angle relative to each of the first direction and the second direction.

11. The inflator and deflator tool of claim 10, wherein the tool head portion includes an arcuate body and an outlet body extending radially away from the arcuate body, the arcuate body including the air inlet and the compression chamber, the outlet body including the air outlet.

12. The inflator tool of claim 11, wherein the air inlet includes a cylindrical inlet member having a bore extending therethrough, the cylindrical inlet member defining the first direction, and wherein the outlet body defines the second direction.

13. The inflator tool of claim 1, wherein the tool head portion includes an arcuate body and an outlet body extending radially away from the arcuate body, the arcuate body including the air inlet and the compression chamber, the outlet body including the air outlet.

* * * * *